United States Patent [19]

Conti

[11] 4,279,354

[45] Jul. 21, 1981

[54] SERVING TRAY

[75] Inventor: Rino Conti, Stoughton, Mass.

[73] Assignee: Dart Industries, Inc., Los Angeles, Calif.

[21] Appl. No.: 176,365

[22] Filed: Aug. 8, 1980

Related U.S. Application Data

[63] Continuation of Ser. No. 11,243, Feb. 12, 1979, abandoned.

[51] Int. Cl.[3] ..... B65D 21/02

[52] U.S. Cl. ..... 220/23.83; 220/20; 220/23.6; 206/501

[58] Field of Search ..... 220/20, 23.4, 23.6, 220/23.8, 23.83, 23.86; 206/501, 504

[56] References Cited

U.S. PATENT DOCUMENTS

| | | | |
|---|---|---|---|
| 1,762,635 | 6/1930 | Lambert | 220/23.8 |
| 2,531,671 | 11/1950 | Dahl | 220/23.8 |
| 2,614,399 | 10/1952 | Roethel | 220/23.4 |
| 3,117,692 | 1/1964 | Carpenter | 206/501 |
| 3,498,494 | 3/1970 | Voorhees | 206/501 |
| 3,501,044 | 3/1970 | Stone | 220/23.4 |
| 3,502,241 | 3/1970 | Smith | 220/23.8 |
| 3,667,647 | 6/1972 | Van Dealer | 220/23.4 |
| 3,751,852 | 8/1973 | Schreppor | 220/23.4 |

*Primary Examiner*—George E. Lowrance
*Attorney, Agent, or Firm*—Leigh B. Taylor

[57] ABSTRACT

A serving tray arrangement including a tray divided by a bifurcated wall member which together with the angled side wall structure of the tray is adapted to support a plurality of differently sized containers in a variety of positions thereon so as to further compartmentalize the assembly in one of many possible arrays for food service.

10 Claims, 8 Drawing Figures

SERVING TRAY

This is a continuation of application Ser. No. 11,243, filed Feb. 12, 1979, now abandoned.

The invention relates to a serving tray arrangement and more particularly to a tray and several closured containers suitable for use in conjunction therewith. Each of the respective elements have utility separate and apart from the others, yet are uniquely constructed to interrelate for food service and storage purposes. Accordingly, each of the containers in the arrangement may be individually closured and such are, in certain instances, securely stackable one atop another. Likewise, the containers with the closures removed may be positioned within the tray in any one of several fashions most suitable for the particular service arrangement desired. Furthermore, the tray alone is compartmentalized so that it may be used simply or in combination with the containers in a particular service arrangement.

Objectively, it can be seen, therefore, that this serving tray arrangement meets several desirable criteria for multi-purpose utilization. By this means a maximum of service arrangements are effectively achieved using a minimum of separate elements.

To accomplish these highly desirable results several salient features of the construction appear significant. First, a tray side wall configuration that is supportive yet enables the easy removal of retained vessels is contemplated. Second, the vessels should exhibit a side wall arrangement of similar configuration. Furthermore, the tray should be modularly separated by a wall that is shaped similarly to the side walls. Additionally, the containers or vessels may employ modular separator themselves such that it is interengageable with that of the tray. And lastly, the vessels are to be closured, such closures having a top wall configuration that enables one to stably stack like units one atop the other.

The prior art in terms of tray structures does illustrate a variety of forms and including inclined side walls and separators. Likewise, such even contemplate the combined use of same with containers adapted to fit within certain tray compartments. None, however, contemplate modular concept and versatility yielded by this structural arrangement. For the most part, the prior art trays spoken of are intended for cafeteria service with the tray serving as the service plate itself.

Other typical sectionalized serving trays also are of a "fixed" structural nature having a single predetermined number of compartments of fixed sizes. These trays are not particularly functional for food storage and accordingly, are limited in terms of potential usage. The tray/-container combination disclosed, on the other hand, permits the user a multitude of compartmental arrangements and provides a plurality of elements suitable for long term food storage pre or subsequent to the service thereof.

Various other objectives and advantages of the invention will become more apparent upon continuing reference to the accompanying specification, claims and drawings wherein:

Figure 1:
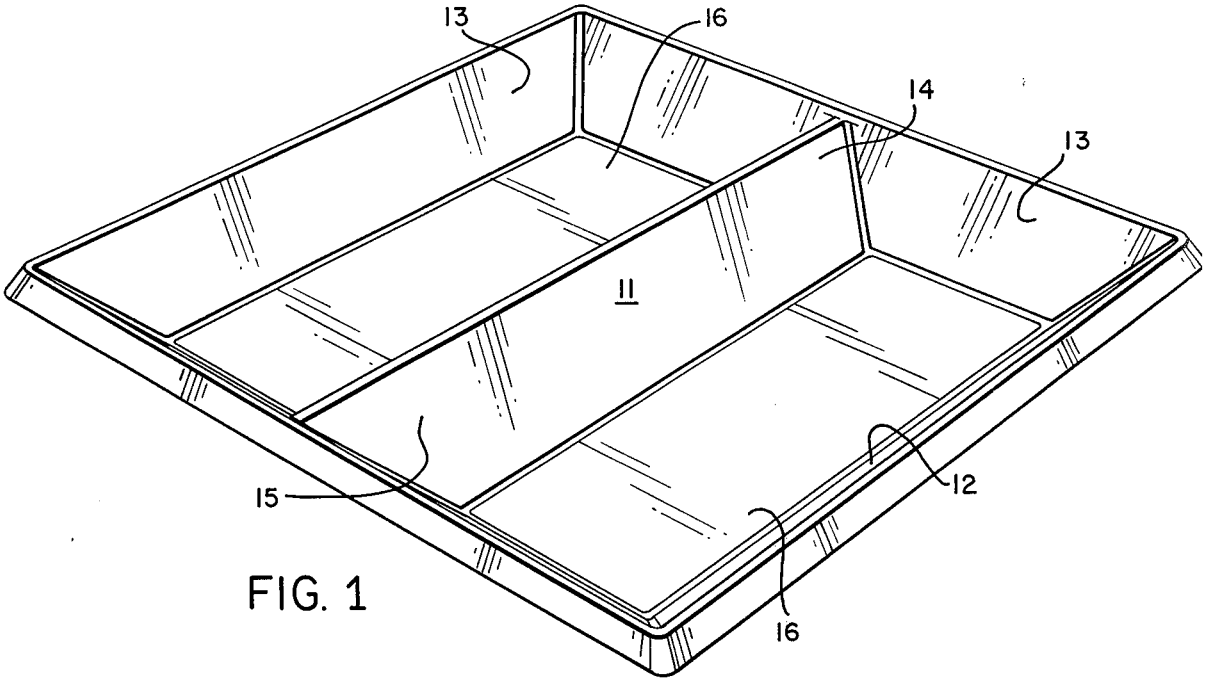
FIG. 1 is a top perspective view of the tray forming a part of the invention.

Referring to the drawings wherein for the sake of illustration is shown the preferred enbodiment of the invention, the reference numeral 10 designates generally the serving tray arrangement which constitutes the invention. This arrangement which, of course, includes a tray 11 and suitably sized and shaped containers 17, is adapted for a variety of preselectable arrangements based upon service need. Such variety is obtainable due to certain unique features of the tray 11 and interrelatable containers 17 which are more fully described hereinbelow.

Figure 2:
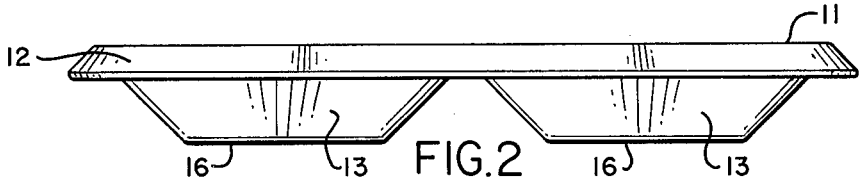
FIG. 2 is a front elevational view of the tray of FIG. 1.
Figure 3:
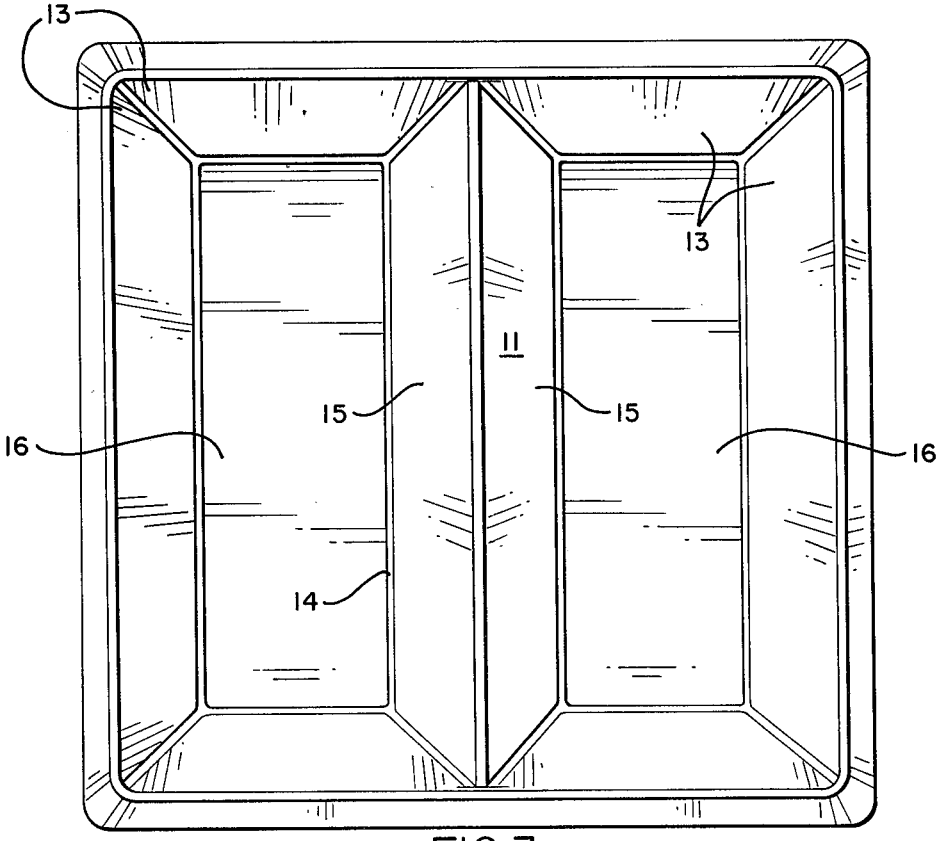
FIG. 3 is a top plan view of the tray of FIG. 1 and which in conjunction with FIGS. 1 and 2 clearly illustrate the tray's side wall and separator arrangement.
Figure 4:
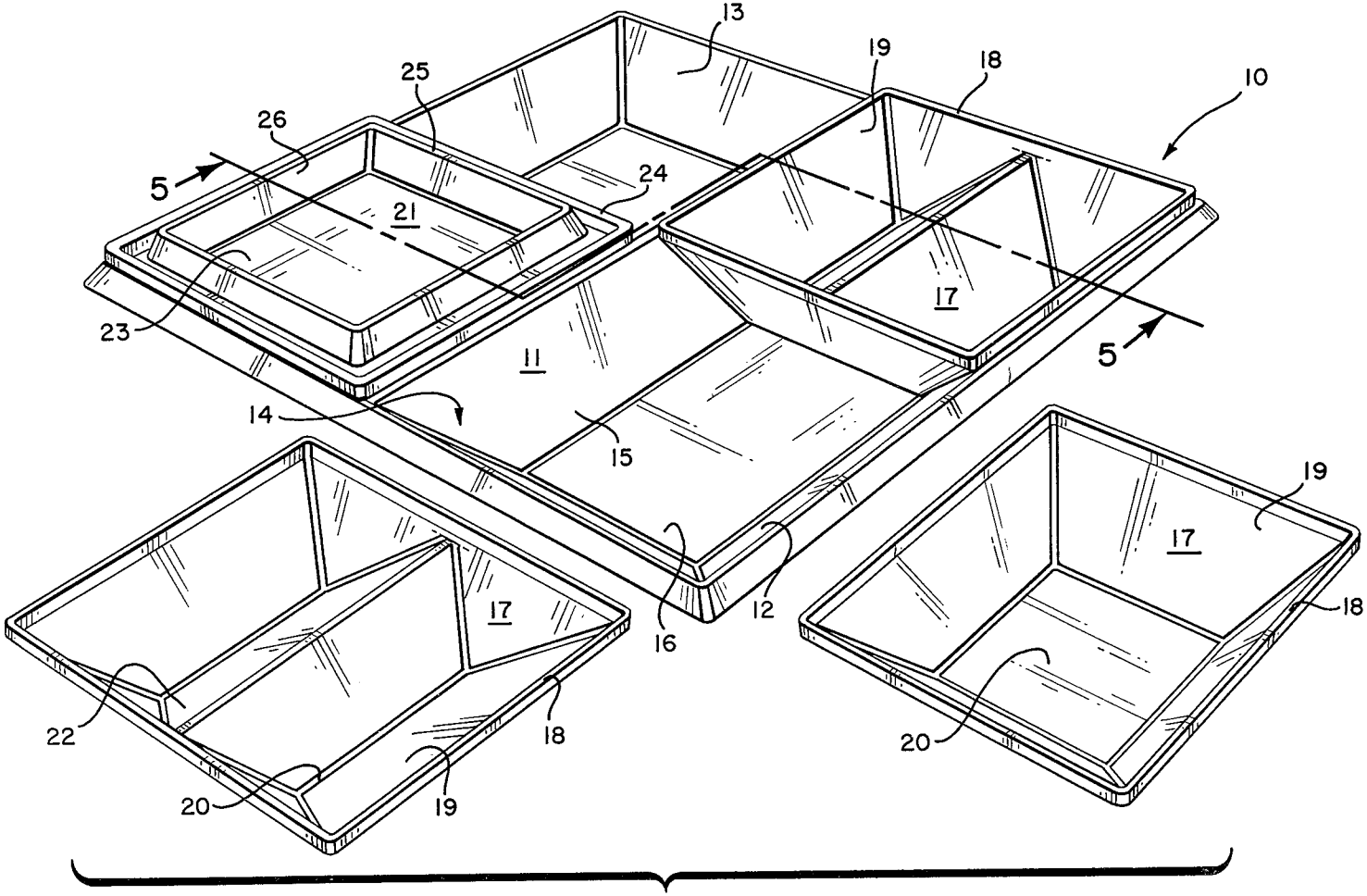
FIG. 4 is an exploded top perspective view of the tray and several of the containers employed in combination therewith.
Figure 5:
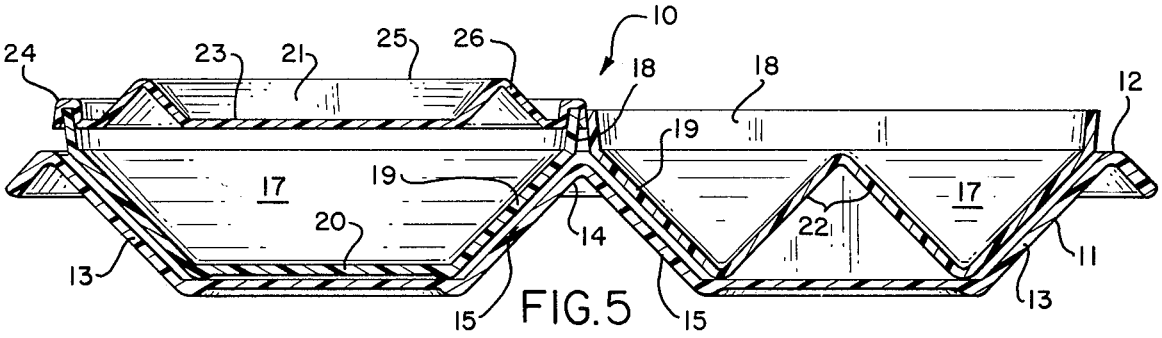
FIG. 5 is an enlarged cross-sectional view of the serving tray arrangement taken along line 5—5 of FIG. 4.

Upon particular reference to FIGS. 1–3 it will be seen that the tray 11 incorporates a peripherally extending flange 12 from which inwardly inclined side walls 13 depend. Compartmentalization of the tray is accomplished with the inclusion of a separator 14 which is formed by the bifurcated wall members 15. Such members, as is further apparent from FIGS. 1–3, are inclined in like fashion to side walls 13. The tray structure is completed by the bottom wall arrangement 16 which is integral with both the side walls 13 and wall members 15. Accordingly, the tray is modularly compartmented and this wall structure enables the easy placement and removal of containers 17 as well as assurance that movement between compartments thereby will be effectively prevented.

It is anticipated that containers 17 will be of a size corresponding to the tray compartments or of a further reduced size modularly adaptable thereto. Accordingly, note that tray 11 is square and its compartments are of equal size and rectangular. However, the containers 17 shown are also square and are of a size approximating one half of each tray compartment or one quarter of the whole tray 11.

Figure 6:
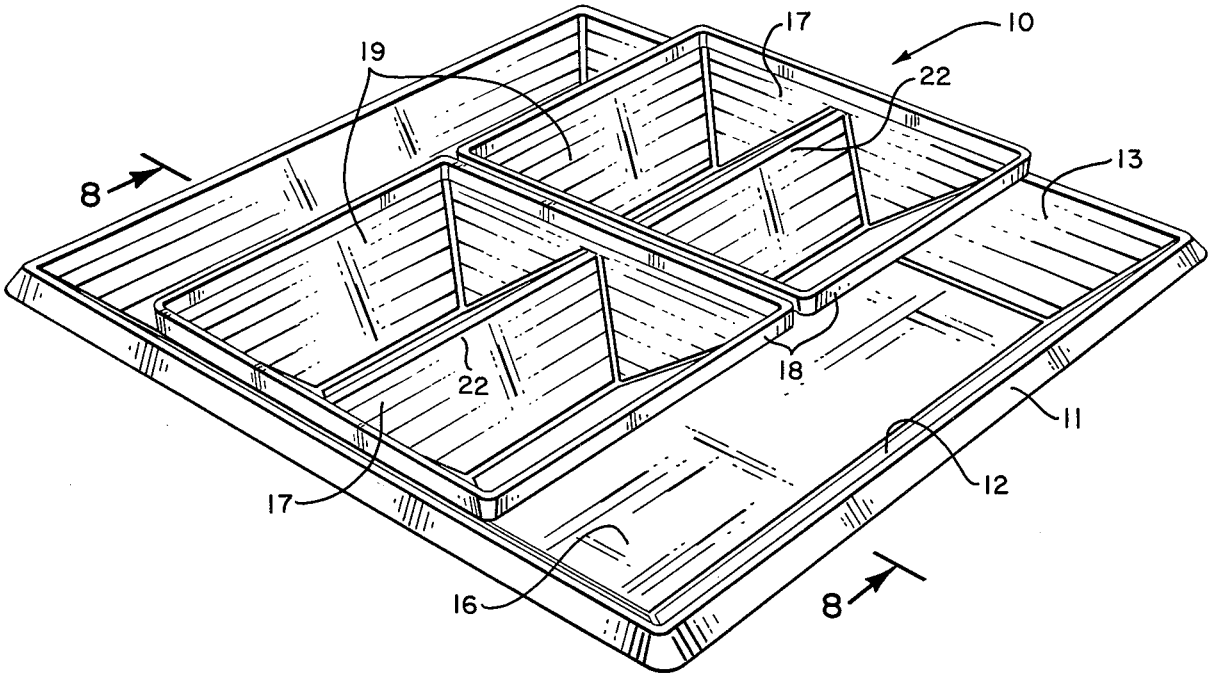
FIG. 6 is a top perspective view of the tray and two similar accompanying containers located therein in yet another fashion.
Figure 7:
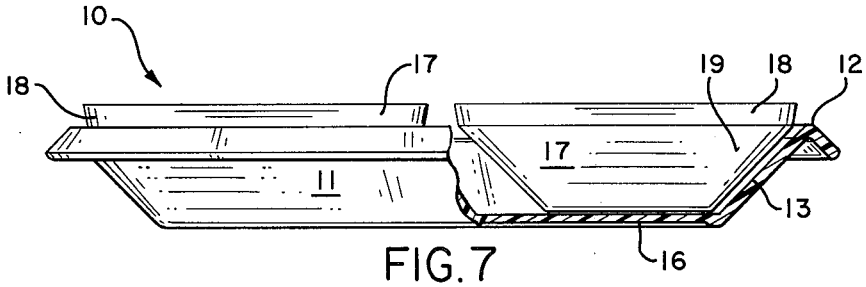
FIG. 7 is a side elevational view partially sectioned of the tray with two containers positioned therein.
Figure 8:
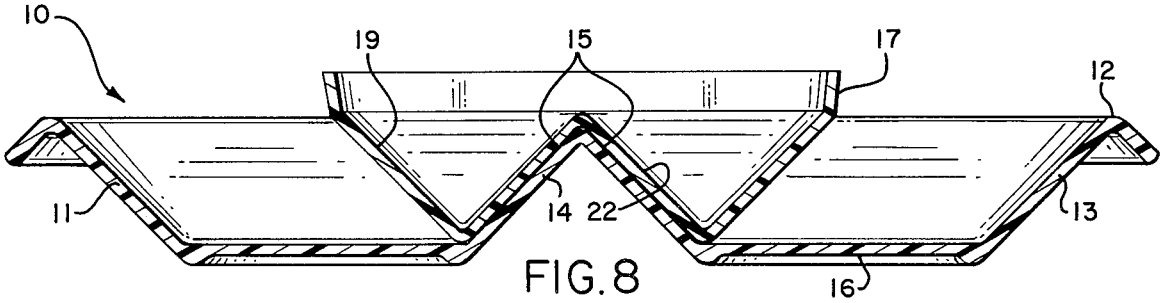
FIG. 8 is an enlarged cross-sectional view of the serving tray arrangement taken along line 8—8 of FIG. 6

Regardless, each container 17 is contemplated as having a marginal brim 18 and depending wall members 19 which are integral with a base 20. As is evident from the drawings, the wall members 19 are inclined similarly to tray side walls 13 and are loosely interengageable therewith. Furthermore, it is suggested that some containers incorporate a divider element 22 which is comparable to separator 14 and is electably interengageable therewith as is illustrated in FIG. 6.

Additionally, each of the containers 17 may accommodate a closure 21 having a top wall element 23 and rim 24. Of course, the rim 24 is shaped for sealing engagement with brim 18 of containers 17. This enables use of each container as a storage vessel separate and apart from the tray. Accordingly, a user may store food stuffs for later service or retain leftovers in the dishes in which they were displayed and served.

Each closure is also intended to incorporate a surface distortion 25 comprised of the V-shaped wall 26. This distortion (wall 26) is so positioned in the top wall element 23 as to enable stable stacking of like containers 17 one atop the other with a base 20 resting thereon and portions of wall members 19 in juxtaposition with the interior of V-shaped wall 26.

From the foregoing it is deemed apparent that a serving tray arrangement of unique qualitites has been conceived and disclosed and that even though certain modifications thereof are possible, such are intended to fall within the scope of protection hereinafter claimed.

I claim:

1. A combined serving tray arrangement adapted for the storage and service of foodstuffs and including a tray having a peripherally extending flange, inwardly inclined generally vertically extending side walls depending from said flange, a separator having bifurcated wall members integral with and extending between two opposed side walls, said separator having a vertical extent approximating the vertical extent of said opposed side walls and angularly disposed in like fashion thereto and a bottom wall arrangement interconnected with said side walls and separator, a container having a marginal brim, container wall means protruding downwardly therefrom, a base integral with said container wall means, said container wall means being of a size, shape and disposition so as to be cooperatively interengageable with said separator, and said container wall means being configured so as to generally be spaced from said bottom wall when said container is straddlingly engaged whereby the upper surface of the bottom wall is generally unobstructed.

2. A combined serving tray arrangement according to claim 1 wherein said container incorporates a closure having a top wall element, a rim extending about said element and mating with said marginal brim and a surface distortion within said element, said distortion being of a size and shape to accommodate the base and a portion of said means of a like container.

3. A combined serving tray arrangement according to claim 2 wherein said container is approximately one fourth the size of said tray.

4. A combined serving tray arrangement according to claim 1 wherein said container is approximately one fourth the size of said tray.

5. A combined serving tray arrangement according to claim 1 wherein said container is approximately one half the size of said tray.

6. A combined serving tray arrangement adapted for the storage and service of foodstuffs and including a tray having a peripherally extending flange, inwardly inclined generally vertically extending side walls depending from said flange, a separator having bifurcated wall members integral with and extending between two opposed side walls, said separator having a vertical extent approximating the vertical extent of said opposed side walls and angularly disposed in like fashion thereto and a bottom wall arrangement interconnected with said side walls and separator, a plurality of containers having marginal brims, container wall means protruding downwardly therefrom and bases integral with said container wall means, said container wall means being of a size, shape and disposition so as to cooperatively interengage portions of a side wall and an opposed separator; at least one of said containers having a divider element of a size, shape and disposition so as to be straddlingly interengageable with said separator, and said container wall means of said at least one of said containers being configured so as to generally be spaced from said bottom wall when said at least one container is straddlingly engaged whereby the upper surface of the bottom wall is generally unobstructed.

7. A combined serving tray arrangement according to claim 6 wherein said container incorporates a closure having a top wall element, a rim extending about said element and mating with said marginal brim and a surface distortion within said element, said distortion being of a size and shape to accommodate the base and a portion of said means of a like container.

8. A combined serving tray arrangement according to claim 7 wherein said container is approximately one fourth the size of said tray.

9. A combined serving tray arrangement according to claim 6 wherein said container is approximately one fourth the size of said tray.

10. A combined serving tray arrangement according to claim 6 wherein said container is approximately one half the size of said tray.

* * * * *